US009706800B2

(12) United States Patent
Tai et al.

(10) Patent No.: US 9,706,800 B2
(45) Date of Patent: Jul. 18, 2017

(54) FACE MASK AND METHOD FOR MAKING THE SAME

(75) Inventors: Jung-Chi Tai, Tainan Hsien (TW); Ho-Hsi Yang, Tainan Hsien (TW); Chien-Hsiang Lin, Tainan Hsien (TW); Chien-Chung Su, Tainan Hsien (TW)

(73) Assignee: Kang Na Hsiung Enterprise Co., Ltd. (TW)

( * ) Notice: Subject to any disclaimer, the term of this patent is extended or adjusted under 35 U.S.C. 154(b) by 1967 days.

(21) Appl. No.: 12/634,535

(22) Filed: Dec. 9, 2009

(65) Prior Publication Data

US 2011/0055998 A1 Mar. 10, 2011

(30) Foreign Application Priority Data

Sep. 7, 2009 (TW) ..... 098130073 A

(51) Int. Cl.
*A41D 13/11* (2006.01)

(52) U.S. Cl.
CPC ..... *A41D 13/1115* (2013.01); *Y10T 156/1051* (2015.01)

(58) Field of Classification Search
USPC ..... 128/205.25, 205.27, 205.29, 128/206.12–206.13, 206.16, 206.19, 128/206.21, 206.23, 206.28, 207.11
See application file for complete search history.

(56) References Cited

U.S. PATENT DOCUMENTS

| | | | | |
|---|---|---|---|---|
| 4,014,047 | A * | 3/1977 | Zobel | 128/206.19 |
| 4,498,620 | A * | 2/1985 | Dickert et al. | 229/117.24 |
| 4,606,341 | A * | 8/1986 | Hubbard et al. | 128/206.19 |
| 4,905,888 | A * | 3/1990 | Suoss et al. | 229/117.22 |
| 5,699,791 | A | 12/1997 | Sukiennik et al. | |
| 2007/0175477 | A1* | 8/2007 | Baggett | 128/206.13 |
| 2008/0035153 | A1* | 2/2008 | Lin | 128/206.27 |
| 2010/0307502 | A1* | 12/2010 | Rummery et al. | 128/205.25 |

FOREIGN PATENT DOCUMENTS

CN 101537237 9/2009

* cited by examiner

*Primary Examiner* — Rachel Young
(74) *Attorney, Agent, or Firm* — Holland & Hart LLP

(57) ABSTRACT

A method for making face masks includes: advancing continuously a longitudinal sheet material that can be divided into a plurality of mask sheets each of which has two opposite longitudinal ends and two opposite transverse ends; cutting the sheet material at intervals to form the mask sheets; providing a plurality of strips each of which has two longitudinally opposite strip ends and each of which is folded to form a pleat between the two strip ends thereof; and bonding the two strip ends of each of the strips to one of the opposite transverse ends of a respective one of the mask sheets to form an ear loop. A structure of the face mask is also disclosed.

5 Claims, 7 Drawing Sheets

FACE MASK AND METHOD FOR MAKING THE SAME

CROSS-REFERENCE TO RELATED APPLICATION

This application claims priority of Taiwanese application no. 098130073, filed on Sep. 7, 2009.

BACKGROUND OF THE INVENTION

1. Field of the Invention

This invention relates to a method for making a face mask, more particularly to a method for making a face mask through high speed automated production and a product made by the method.

2. Description of the Related Art

As shown in FIG. 1, a commercial face mask 9 usually comprises a mask sheet 91 and a pair of ear loops 92. The mask sheet 91 is formed with several pleats 94 that can be stretched to increase a covering area for a user's face. Furthermore, the mask sheet 91 has a bendable metal strip 93 enclosed in an upper edge of the mask sheet 91 for pressing against the user's nose. Each of the ear loops 92 has two opposite ends attached to the mask sheet 91 and is usually made of an elastic band for fitting over one of the user's ears.

A conventional method for making the face mask 9 that has ear loops 92 made of the elastic band comprises: laminating a plurality of non-woven fabric layers (for example, an outer layer, an intermediate layer, and an inner layer) to form a continuous longitudinal sheet; cutting the continuous longitudinal sheet at intervals to form a plurality of mask sheets 91; bending and disposing the elastic bands such that two ends of each elastic band are disposed at predetermined positions of the mask sheet 91; and attaching the elastic bands to the mask sheet 91 by using bias tapes 95 to form the pair of ear loops 92 (see FIG. 2).

In general, the mask sheet 91 can be produced at a speed of 100~120 pieces/min. However, since the elastic bands are easily deformed, and since the elastic bands should be disposed on the mask sheet 91 in a bent form, the rate of forming the ear loops 92 is 30~35 pieces/min and thus is relatively low compared to the production rate for the mask sheet 91. Therefore, the conventional method cannot produce the face mask 9 continuously at a high speed. Accordingly, there is a need to increase the speed of attaching the elastic bands to the mask sheet 91.

SUMMARY OF THE INVENTION

Therefore, in order to solve the problem mentioned above, an object of the present invention is to provide a method for making a face mask that can be conducted continuously, and a product of the method.

According to one aspect of the present invention, there is provided a method for making a face mask, comprising:

advancing continuously a longitudinal sheet material that can be divided into a plurality of mask sheets each of which has two opposite longitudinal ends and two opposite transverse ends;

cutting the sheet material at intervals to separate the mask sheets;

providing a plurality of strips each of which has two longitudinally opposite strip ends and each of which is folded to form a pleat between the two strip ends thereof; and bonding the two strip ends of each of the strips to one of the opposite transverse ends of a respective one of the mask sheets to form an ear loop.

According to another aspect of the present invention, there is provided a face mask comprising a mask sheet, and a pair of ear loops. Each of the ear loops is made of an elastic strip, and has two opposite strip ends bonded to the mask sheet and a pleat between the strip ends.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
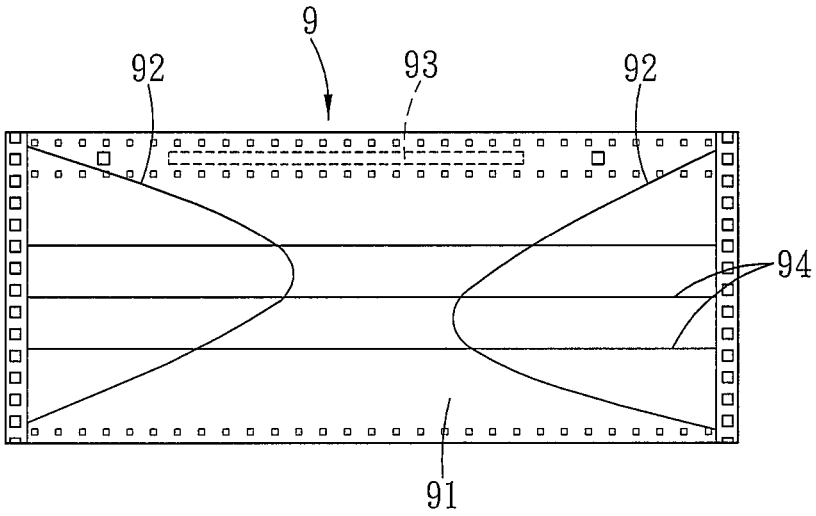
FIG. 1 PRIOR ART
FIG. 1 is a plan view of a conventional face mask.
Figure 2:
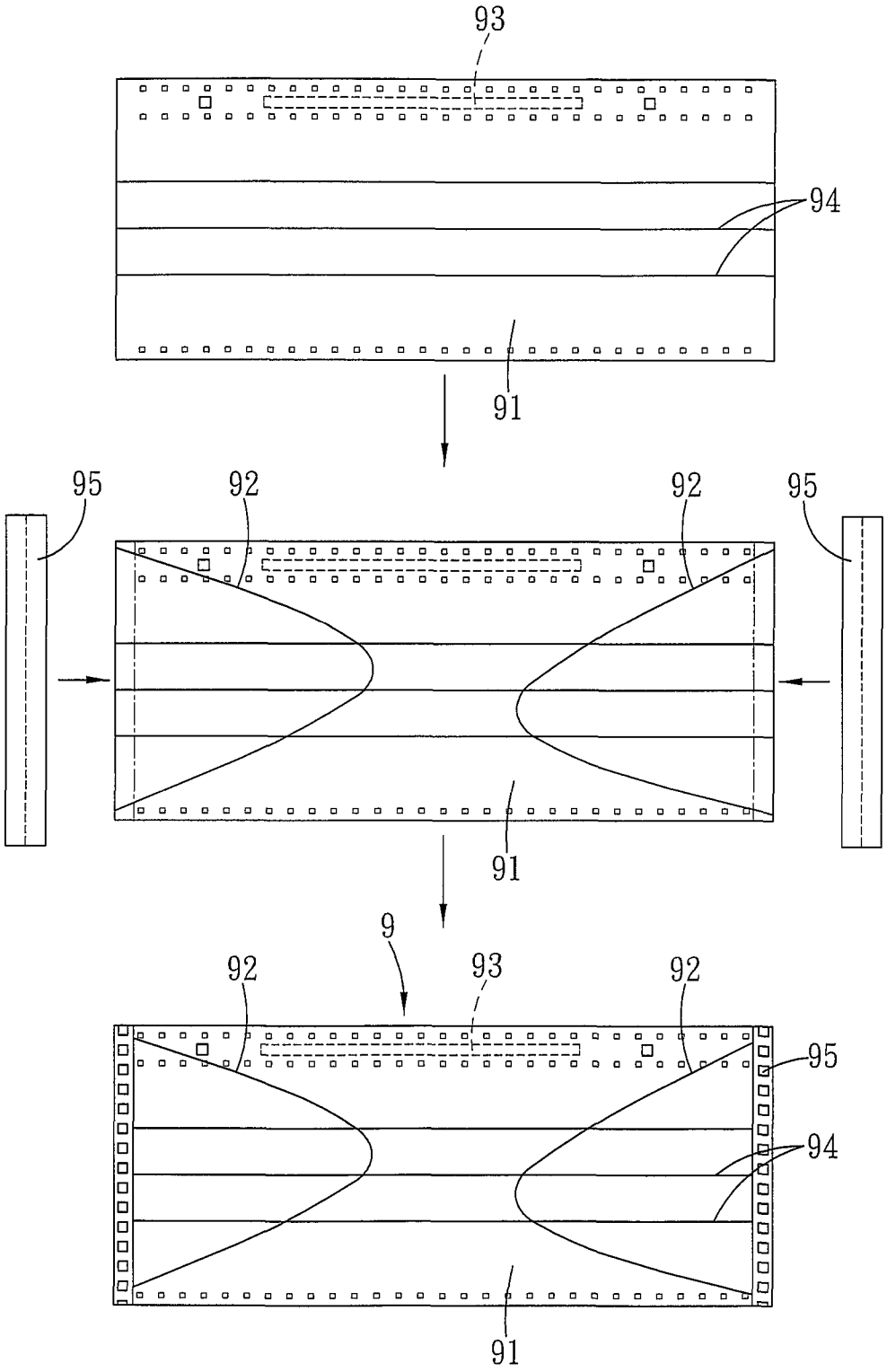
FIG. 2 PRIOR ART
FIG. 2 is a schematic diagram illustrating how a pair of ear loops are formed using a conventional method for making a face mask.
Figure 3:
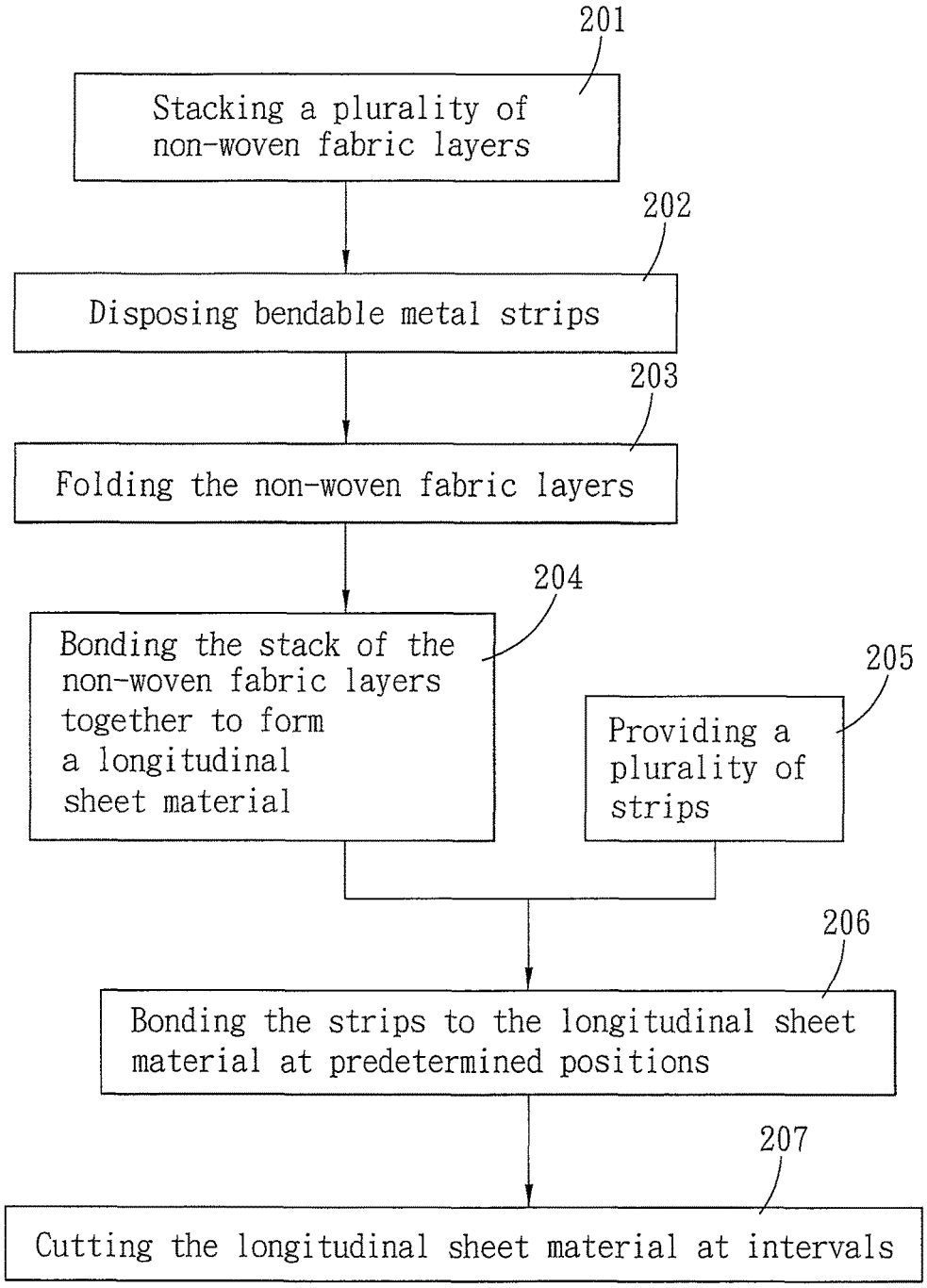
FIG. 3 is a flow chart showing a method for making a face mask according to a preferred embodiment of the present invention.

Referring to FIG. 3, the preferred embodiment of the method for making a face mask according to the present invention comprises step 201 of stacking a plurality of non-woven fabric layers, step 202 of disposing bendable metal strips, step 203 of folding the non-woven fabric layers, step 204 of bonding the stack of the non-woven fabric layers together to form a longitudinal sheet material, step 205 of providing a plurality of strips, step 206 of bonding the strips to the longitudinal sheet material at predetermined positions, and step 207 of cutting the longitudinal sheet material at intervals. Since steps 201~204 are the same as the prior art method, these steps are briefly described as follows. In step 201 of the preferred embodiment, three non-woven fabric layers (not shown, for example, an outer layer, an intermediate layer, and an inner lining layer) are respectively taken out from stock-rollers thereof (not shown), are guided by guiding rollers (not shown), and then are stacked in sequence. The inner lining layer has a width larger than those of the outer and intermediate layers, and thus, has two longitudinal marginal parts extended beyond the longitudinal margins of the outer and intermediate layers. The intermediate layer functions as a filter.

In step 202, bendable metal strips 13 (see FIG. 4) are attached to the outer layer at intervals along a longitudinal direction.

In step 203, the two marginal parts of the inner layer are folded over the outer layer, and the stacked three non-woven fabric layers are folded to have pleats 14. By this step, the longitudinal margins of the outer and intermediate layers, and the bendable metal strips 13 attached to the outer layer are covered by the two marginal parts of the inner layer (see FIG. 4).

Figure 4:
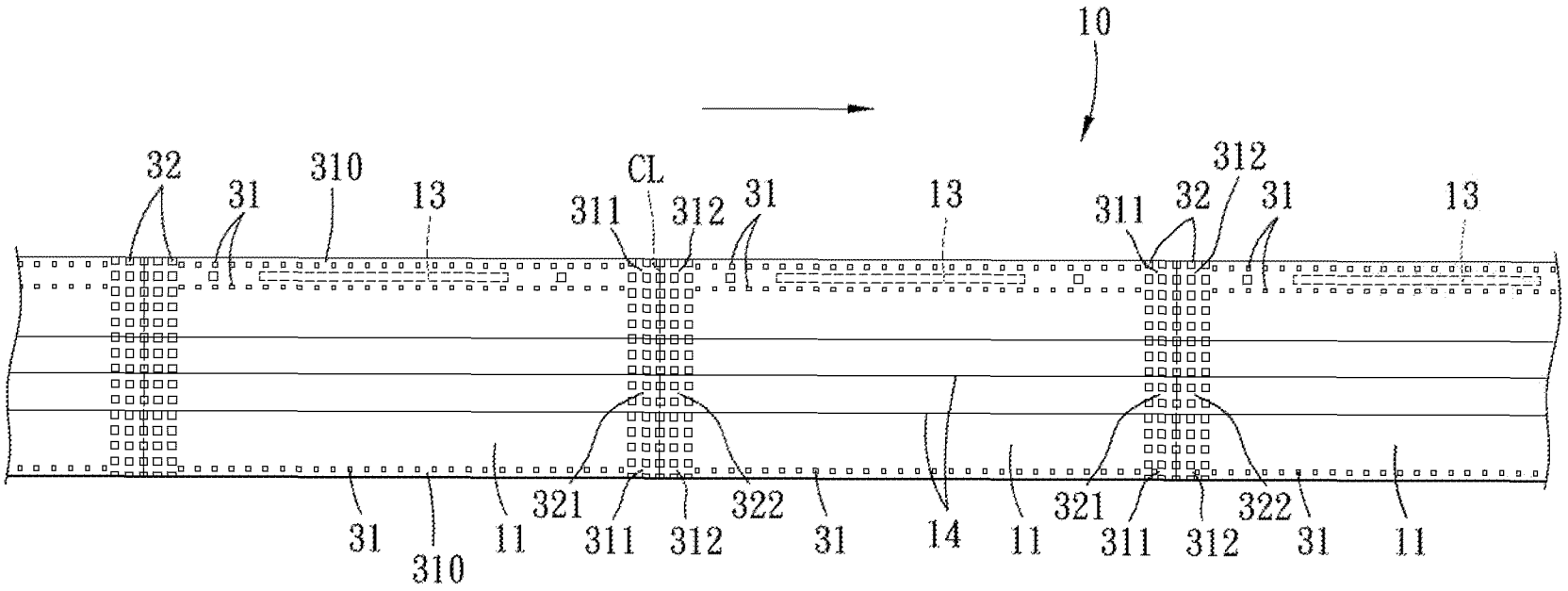
FIG. 4 is a schematic diagram illustrating a longitudinal sheet material that is advanced continuously.
Figure 5:
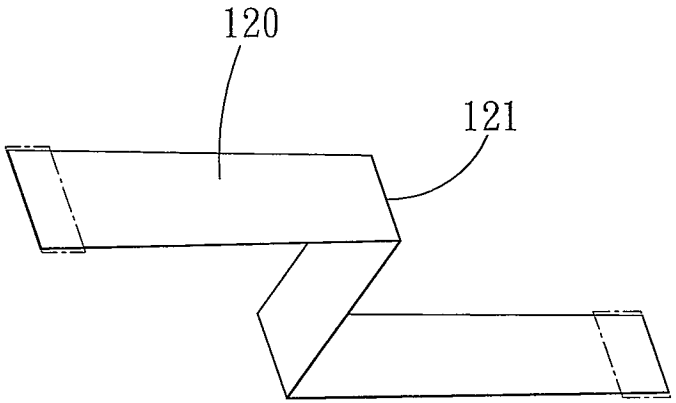
FIG. 5 is a schematic diagram showing a strip provided with a pleat and used for forming an ear loop according to the present invention.

In step 204, the three non-woven fabric layers are bonded together by heat-pressing or ultrasonic bonding, thereby forming the longitudinal sheet material sheet stock) 10. By this step, as shown in FIG. 4, longitudinal bonding lines 31 extend longitudinally of the longitudinal sheet material 10 in lateral regions 310, and the longitudinal sheet material 10 are divided into a plurality of mask sheets 11 by transverse bonding lines 32 in leading marginal regions 321 and trailing marginal regions 322. Each of the mask sheets 11 has two opposite longitudinal ends 111 and two opposite transverse ends 112 (see FIGS. 6 and 7).

In step 205, a plurality of elastic strips 120 are provided at one processing station while the steps 201~204 are conducted (see FIG. 3) simultaneously at another processing station to form and advance the longitudinal sheet material 10 continuously. Each strip 120 has two longitudinally opposite strip ends and is folded to form a pleat 121 between the two strip ends thereof. Each strip 120 has a length longer than a width of the longitudinal sheet material 10 before the respective pleat 121 is formed, but has the length slightly shorter than the width of the longitudinal sheet material 10 after the respective pleat 121 is folded (see FIGS. 3, 6 and 7).

Preferably, the strips 120 are heat-pressed so as to form the pleat 121.

In the preferred embodiment, the strips 120 are made from an elastic non-woven fabric sheet (not shown) which is cut and divided into the strips 120 and which is folded to form a Z-shaped pleat before being cut. The elastic non-woven fabric sheet can be produced by a meltblown method or a spunbond method. Otherwise, the elastic non-woven fabric sheet can be made by blending a normal non-woven fabric with any elastic materials.

Figure 6:
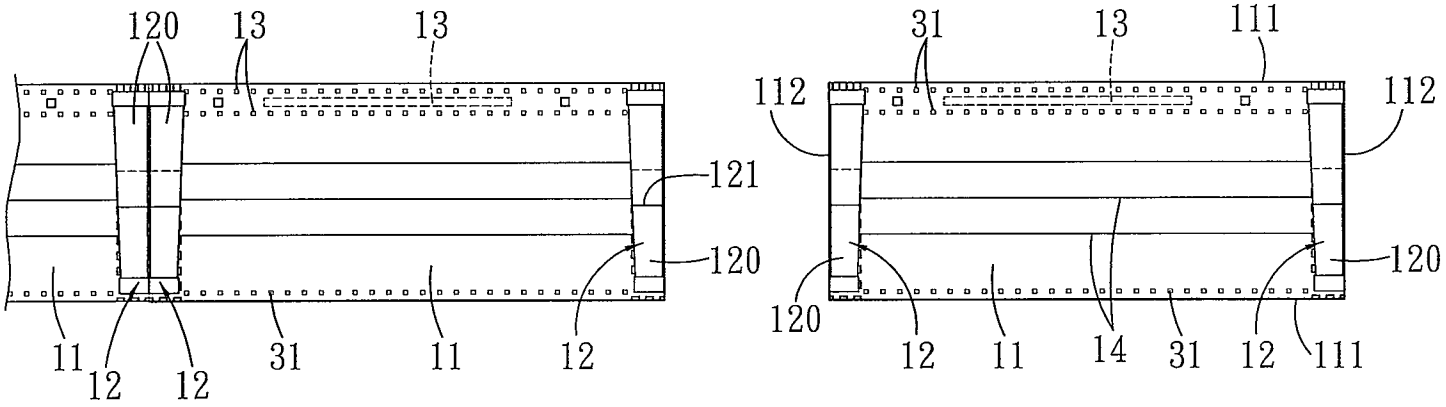
FIG. 6 is a schematic diagram showing the sheet material being cut at intervals after the ear loops are bonded to the longitudinal sheet material.
Figure 7:
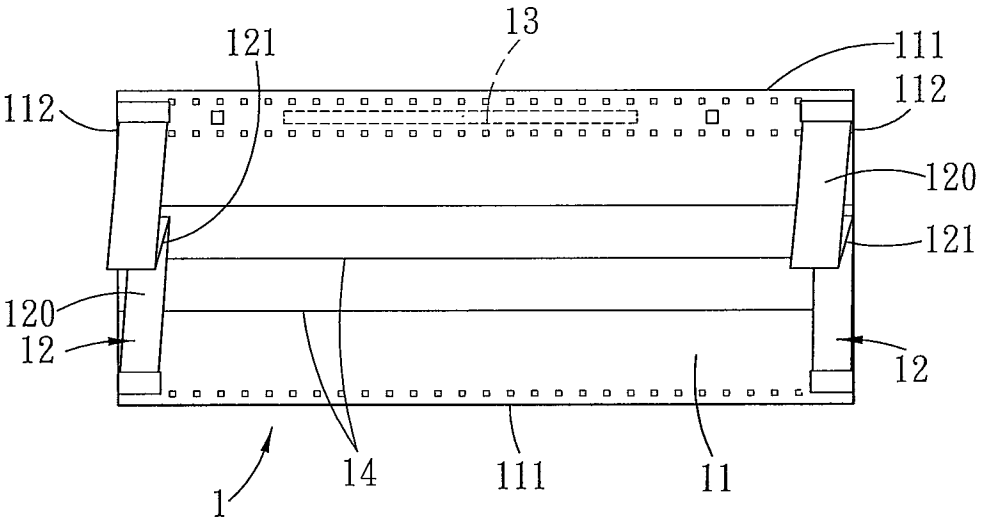
FIG. 7 is a face mask made by the method shown in FIG. 3.

In step 206, the strips 120 are bonded to the longitudinal sheet material 10 at predetermined positions (e.g., at two opposite attachment areas 311 of a leading marginal region 321, the attachment areas 311 being disposed respectively at the lateral regions 310; and at two opposite attachment areas 312 of a trailing marginal region 322, the attachment areas 312 also being disposed respectively at the lateral regions 310). In detail, as shown in FIGS. 6 and 7, each strip 120 is disposed along one of the two opposite transverse ends 112 of a respective one of the mask sheets 11. The two longitudinally opposite strip ends of each strip 120 are aligned substantially and respectively with two opposite longitudinal ends 111 of the respective one of the mask sheets 11 and are subjected to heat-pressing or ultrasonic bonding at the intersection of the longitudinal and transverse bonding lines 31, 32. By this step, a pair of ear loops 12 are formed on each of the mask sheets 11.

In step 207, the longitudinal sheet material 10 is cut at intervals along predetermined rutting lines (CL) to separate the mask sheets 11 (see FIGS. 4 and 6).

Since the strips 120 respectively have Z-shaped pleats 121 which are formed by heat-pressing and which are not easily deformed during the step 206 of bonding the strips 120, the step 206 can be conducted in coordination with the other steps 201~205, and 207. Therefore, by the method according to the present invention, the face mask 1 can be manufactured through a line production.

It should be noted that, in another embodiment, the step 206 can also be conducted after step 207. That is to say, the method according to the present invention can also be conducted by a conventional equipment for making the mask sheets 11, followed by bonding the strips 120 to the mask sheets 11 to form the ear loops 12 on the mask sheets 11.

As shown in FIG. 7, in the preferred embodiment, the face mask 1 made by the method according to the present invention has a mask sheet 11, and a pair of ear loops 12. Each of the ear loops 12 is made of an elastic strip 120 and has two opposite strip ends bonded to the mask sheet 11, and a pleat 121 between the strip ends. The mask sheet 11 is formed with several pleats 14 that can be stretched to increase a covering area for a user's face. Furthermore, the mask sheet 11 has a bendable metal strip 13 enclosed in an upper margin of the mask sheet 11 and pressable to conform with a shape of the user's nose.

Preferably, the elastic strips 120 are made of an elastic non-woven fabric.

While the present invention has been described in connection with what are considered the most practical and preferred embodiments, it is understood that this invention is not limited to the disclosed embodiments but is intended to cover various arrangements included within the spirit and scope of the broadest interpretations and equivalent arrangements.

What is claimed is:

1. A method for making face masks, comprising:

advancing continuously a longitudinal sheet stock that includes a plurality of mask sheets displaced from each other in a longitudinal direction and connected by a plurality of predetermined cutting lines, each of the mask sheets having two opposite lateral regions, a leading marginal region that has two opposite attachment areas disposed respectively at the lateral regions, and a trailing marginal region that has two opposite attachment areas disposed respectively at the lateral regions, and that is connected to the leading marginal region of a next one of the mask sheets through a corresponding one of the predetermined cutting lines;

providing a plurality of strips each of which has two attachment ends and each of which is folded in a lengthwise direction;

superposing each of the folded strips on a corresponding one of the leading and trailing marginal regions;

bonding the two attachment ends of each of the folded strips respectively to the two opposite attachment areas of the corresponding one of the leading and trailing marginal regions; and cutting the sheet stock along the predetermined cutting lines.

2. The method of claim 1, wherein the bonding of the two attachment ends of each of the strips is conducted after the sheet stock is cut.

3. The method of claim 1, wherein the bonding of the two attachment ends of each of the strips is conducted before the sheet stock is cut.

4. The method of claim 1, wherein the strips are made of an elastic non-woven fabric.

5. The method of claim 1, wherein each of the strips is folded by heat-pressing.

* * * * *